US009085062B2

(12) United States Patent
Holroyd et al.

(10) Patent No.: US 9,085,062 B2
(45) Date of Patent: Jul. 21, 2015

(54) STABILISATION OF STORED GAS

(75) Inventors: Nigel John Henry Holroyd, Riverside, CA (US); Sharon Laraine Havercroft, Riverside, CA (US); Garland Elmo Scott, Prospect, KY (US)

(73) Assignee: LUXFER GROUP LIMITED, Salford (GB)

( * ) Notice: Subject to any disclaimer, the term of this patent is extended or adjusted under 35 U.S.C. 154(b) by 618 days.

(21) Appl. No.: 12/677,998

(22) PCT Filed: Sep. 12, 2008

(86) PCT No.: PCT/GB2008/003094

§ 371 (c)(1),
(2), (4) Date: Oct. 14, 2010

(87) PCT Pub. No.: WO2009/034336

PCT Pub. Date: Mar. 19, 2009

(65) Prior Publication Data

US 2011/0017614 A1 Jan. 27, 2011

Related U.S. Application Data

(60) Provisional application No. 60/972,260, filed on Sep. 14, 2007.

(51) Int. Cl.

| | |
|---|---|
| ***C23F 1/00*** | (2006.01) |
| ***B24B 31/00*** | (2006.01) |
| ***F17C 1/14*** | (2006.01) |

(52) U.S. Cl.

CPC ..... *B24B 31/006* (2013.01); *F17C 1/14* (2013.01); *F17C 2203/0604* (2013.01);

(Continued)

(58) Field of Classification Search

USPC ..... 216/83, 89, 102; 206/0.6; 428/34.1, 428/846.4

See application file for complete search history.

(56) References Cited

U.S. PATENT DOCUMENTS 4,435,223 A * 3/1984 Dollman ..... 134/3
4,956,022 A * 9/1990 Mahmoud ..... 134/41

(Continued)

FOREIGN PATENT DOCUMENTS

DE 1184585 12/1964
DE 19628842 12/1998

(Continued)

OTHER PUBLICATIONS

Robert Benesch, Malik Haouchine and Tracey Jacksier, "The Stability of 100 ppb Hydrogen Sulfide in Standards", Analytical Chemistry, vol. 76, No. 24, pp. 7396-7399, Dec. 15, 2004, Countryside, Illinois, U.S.A.

(Continued)

*Primary Examiner* — Sahmim Ahmed

(57) ABSTRACT

A method of treating the internal surface of a container for the storage of gas, such as a gas cylinder, that is made from or lined with aluminum or aluminum alloy. The method is characterized in that it comprises creating a freshly exposed aluminum surface, for example by the use of a wet grinding, in the presence of a surfactant. The surfactant is preferably derived from $C_6$-$C_{18}$ carboxylic acids. The container for the storage of gas provides long-term gas stability. The internal surface of the container has a substantially continuous disturbed layer and is hydrophobic. It may also incorporate groups or species derived from the surfactant and/or comprise oxides or oxyhydroxides of aluminum.

20 Claims, 5 Drawing Sheets

Figure 1:
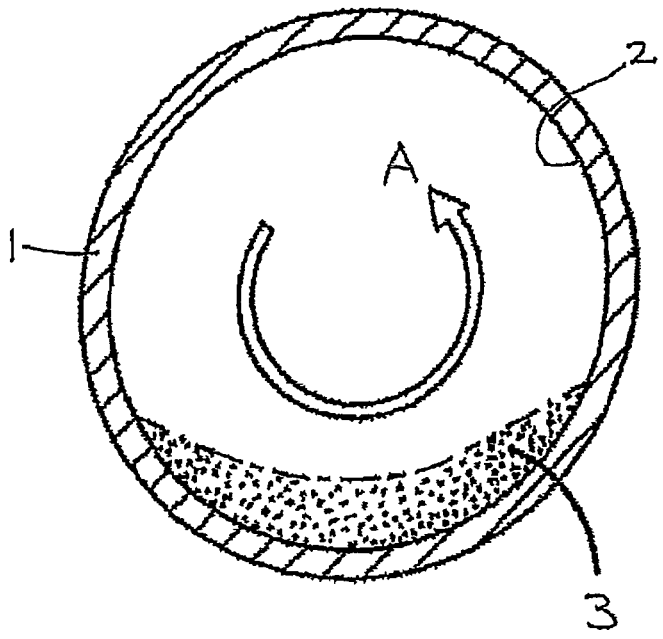

(52) U.S. Cl.
CPC .. *F17C 2203/066* (2013.01); *F17C 2203/0646* (2013.01); *F17C 2203/0648* (2013.01); *F17C 2203/0663* (2013.01); *F17C 2209/2181* (2013.01); *F17C 2221/014* (2013.01); *F17C 2221/037* (2013.01); *F17C 2223/035* (2013.01); *F17C 2260/044* (2013.01); *F17C 2270/0518* (2013.01)

(56) References Cited

U.S. PATENT DOCUMENTS

| | | | | |
|---|---|---|---|---|
| 5,110,494 | A * | 5/1992 | Beck | 134/41 |
| 5,279,677 | A * | 1/1994 | Das | 134/3 |
| 5,378,379 | A * | 1/1995 | Bershas | 508/165 |
| 5,545,438 | A | 8/1996 | Ouyang et al. | |
| 5,614,035 | A | 3/1997 | Nadkarni | |
| 6,789,602 | B2 * | 9/2004 | Li et al. | 164/4.1 |
| 2004/0026417 | A1 | 2/2004 | Kikkawa et al. | |
| 2008/0078754 | A1 | 4/2008 | Hosemann et al. | |

FOREIGN PATENT DOCUMENTS

| | | |
|---|---|---|
| EP | 0324394 | 7/1989 |
| JP | 62080282 | 4/1987 |
| JP | 08-041596 | 2/1996 |
| JP | 2007220995 | 8/2007 |

OTHER PUBLICATIONS

R. C. McCune, R. L. Shilts and S. M. Ferguson, "A Study of Film Formation on Aluminum in Aqueous Solutions Using Rutherford Backscattered Spectroscopy", Corrosion Science, vol. 22, No. 11, pp. 1049-1065, 1982, Great Britain.

William F. Bleam, Philip E. Pfeffer, Sabine Goldberg, Robert W. Taylor and Robert Dudley, "A 31P Solid-State Nuclear Magnetic Resonance Study of Phosphate Adsorption at the Boehmite/Aqueous Solution Interface", American Chemical Society, Langmuir, vol. 7, No. 8, pp. 1707-1712, 1991, U.S.A.

Wei Li, Jian Feng, K D Kwon, J D Kubicki and Brian L. Philips, "Surface Speciation of Phosphate on Boehmite (β-AIOOH) Determined from NMR Spectroscopy", Langmuir, 26 (7) 4753-4761, Feb. 2010, U.S.A.

Wei Li, Xiongham Feng, Yupeng Yan, Donald L. Sparks and Brian L. Phillips, "Solid-State NMR Spectroscopic Study of Phosphate Sorption Mechanisms on Aluminum (Hydr)oxides", Environ. Sci. Technol., vol. 47, pp. 8308-8315, Jul. 2013, U.S.A.

Sabine Goldberg, James A. Davis and John D. Hem, "The Surface Chemistry of Aluminum Oxides and Hydroxides" Chapter 7 in "The Environmental Chemistry of Aluminum", Ed Garrison pp. 271-331, CRC Lewis Publishers, 2nd Edition, 1996.

C M A Brett, I A R Gomes and J P S Martins, 'The Electrochemical Behaviour and Corrosion of Aluminum in chloride Media—The effect of Anions', Corrosion Science, 36, 915-925, 1994.

D Y Lee, T H Nam, I J Park, J G Kim and J Ahn, 'Corrosion Behavior of Aluminum Alloy for Heat Exchanger in Exhaust Gas Recirculation System of Diesel Engine', Corrosion 69 (8), 828-836, 2013.

* cited by examiner

| Days | C1 | C2 | C3 | P1 | P2 | P3 |
|---|---|---|---|---|---|---|
| 0 | 26.8 | 26.3 | 25.7 | 26.8 | 26.3 | 25.7 |
| 1 | 25.9 | 25.2 | 24.7 | 26.6 | 26.3 | 25.7 |
| 2 | 25.4 | 25.1 | 24.5 | 26.6 | 26.2 | 25.6 |
| 4 | 25.0 | | | 26.5 | | |
| 5 | | 24.5 | 23.9 | | 26.1 | 25.5 |
| 7 | 24.6 | | | 26.5 | | |
| 9 | | 24.1 | 23.3 | | 26.0 | 25.4 |
| 16 | 24.0 | | | 26.4 | | |
| 19 | | 23.2 | 22.7 | | 26.1 | 25.3 |
| 35 | 22.8 | 22.4 | 21.9 | 26.2 | 26.0 | 25.3 |
| 66 | 21.9 | | | 26.2 | | |
| 68 | | | 20.6 | | | 25.3 |
| 69 | | 21.3 | | | 25.9 | |
| 223 | | | | | 25.8 | |
| 225 | | | | 26.2 | | 25.2 |
| 247 | | | 16.5 | | | 25.3 |
| 254 | | 16.2 | | | 25.8 | |
| 256 | 17.5 | | | 26.2 | | |
| 268 | | 16.3 | | | | |
| 270 | | | 16.3 | | | |
| 345 | 17.2 | | | 26.1 | | |
| 483 | | 13.7 | | | 25.9 | |

| Days | C1 | C2 | C3 | P1 | P2 | P3 | P4 | P5 |
|---|---|---|---|---|---|---|---|---|
| 0.5 | 24.5 | 24.5 | 24.3 | 24.9 | 25 | 25 | 25 | 25 |
| 1.6 | 24.1 | 23.9 | 23.8 | 24.9 | 24.9 | 24.9 | 24.9 | 24.7 |
| 5.6 | 23.3 | 23.2 | 22.9 | 24.8 | 24.8 | 24.8 | 24.9 | 24.8 |
| 16.8 | 22.2 | 22.3 | 21.5 | 24.5 | 24.6 | 24.6 | 24.6 | 24.5 |
| 22.7 | 21.8 | 21.8 | 21 | 24.6 | 24.5 | 24.6 | 24.6 | 24.5 |
| 29.7 | 21.3 | 21.4 | 20.6 | 24.4 | 24.5 | 24.5 | 24.5 | 24.4 |
| 63.6 | 19.5 | 19.7 | 18.4 | 24.2 | 24.2 | 24.4 | 24.3 | 24 |
| 120.8 | 17.4 | 17.8 | 16.3 | 24 | 23.9 | 23.9 | 24.1 | 23.8 |

STABILISATION OF STORED GAS

This invention relates to the treatment of an aluminium surface, for example a tube or cylinder which has been formed from aluminium or its alloys. It further relates to the stability of gas stored within a container and is directed both to a storage container and to a method of treating the inside surface of such a container. The invention is particularly concerned with the storage of gases and gas mixtures under pressure in storage cylinders made of aluminium or its alloys, which will provide long-term gas stability.

It is known that many stored gases and gas mixtures degrade when subjected to storage in a closed container. This can be due both to reactions occurring within the gas itself, and to reactions between the gas and the material of the cylinder. These reactions can cause impurities to be introduced into the gas and/or the gas concentration to change over time. The reactions are more pronounced in small volume cylinders because of the cylinder's greater internal surface area to internal volume ratio.

Whilst it is clearly desirable that stored gases should remain stable over time, a particular problem arises in the storage of certain gases. Calibration gas is gas which is used as a reference for calibration of gas sensors and the like, for example pollution sensors, and it is necessary that the gas which is used has properties which are both known and stable. Calibration standards of the order of a few parts per million concentration of the active constituents are now being demanded by industry to be coupled with an active constituent stability of less than 1 part per million over an extended period. Many gases are used as calibration gases. A typical example known to present a particular challenge to industry is 20-50 parts per million hydrogen sulphide, ($H_2S$) in air, particularly when the gas mixture is stored in smaller volume cylinders offering portability.

High purity gases (e.g. those having 99.999% or even 99.9999% purity), such as arsine or nitrogen when used in the semiconductor industry, are other examples of gases that must be stored under conditions that prevent gas purity degradation, moisture contamination or particulate generation by interaction with the container.

Gas stability is understood to mean that the composition of the gas supplied from the cylinder remains within acceptable limits after prolonged storage. The applicable limits will depend on the application, being most stringent for gases used for calibration or in the electronics industry. Various methods of treating cylinders to maintain gas stability are known. These methods generally involve treating the inside surface of the cylinder in some way, either by applying a chemical or electrochemical process, mechanical abrasion or the application of a coating, or a combination of some or all of these methods. For example, a method of chemically treating the inside surface of pressure cylinders is described in JP-A-2004/354189. The method described is said to chemically polish the inside surface of the cylinder. In U.S. Pat. No. 5,803,795 and U.S. Pat. No. 7,021,487 are described mechanical methods of treating the inside surface of steel cylinders. For example, U.S. Pat. No. 5,803,795 describes a wet grinding process in which an abrasive is used to obtain a surface roughness of 3 μm or less. The abrasive is introduced into the cylinder and the cylinder is revolved about a horizontal axis so that the abrasive acts on the internal surfaces to achieve the required surface roughness.

EP 0824970 describes a cylinder whose internal surface is coated with a film to which non-polar organic molecules will not adhere. JP 54134070 and JP 55115694 also disclose methods of coating the internal surface of cylinders with a view to maintaining the stability of stored gas. WO 2005/088185 describes the application of an oxide-based passivated film, such as aluminium oxide, onto that surface of a gas container which is in contact with the gas; the surface having an average roughness of 1 μm or less in terms of a centre line average roughness Ra. This is said to prevent contamination of the stored gas.

The method of the present invention is of the wet grinding type, such as described in U.S. Pat. No. 5,803,795, but using a surfactant during grinding and utilising cylinders made of aluminium or its alloys, which for many gases and gas mixtures are generally regarded as providing a better performance, from the point of view of stored gas stability, than standard steel cylinders.

According to a first embodiment of the invention there is provided a method of treating the internal surface of a container for the storage of gas, said container being made from or lined with aluminium or aluminium alloy, characterised in that the method comprises creating a freshly exposed aluminium surface in the presence of a surfactant.

According to a preferred embodiment of the invention, the freshly exposed surface is created by a wet grinding method, characterised in that the media used for grinding comprises a mixture containing at least an abrasive, a surfactant and water. Tumbling is an example of a wet grinding method.

The term "aluminium pressure cylinder" used in this specification is intended to embrace all containers, made of aluminium and/or one or more of its alloys, suitable to contain a fluid, preferably gas, under pressure. Suitable alloys fall within the AA2XXX, AA5XXX, AA6XXX, AA7XXX and AA8XXX series, in particular AA6061, AA7032 and AA7060, classified according to the International Alloy Designations and Chemical Composition Limits for Wrought Aluminium and Wrought Aluminium Alloys published by "The Aluminum Association" revised 2001. The cylinder could be solid aluminium or aluminium alloy, or with an inner layer of aluminium or aluminium alloy, for example, in a plastic, glass, ceramic or composite fibre wrapped cylinder. An example would be a carbon fibre wrapped cylinder with an aluminium or aluminium alloy liner.

The abrasive mixture is preferably in the form of a slurry which is moved across the inside surface of the cylinder in order to abrade or polish the surface to reduce its surface roughness. A preferred method of achieving this is to introduce the abrasive slurry into the cylinder and then rotate the cylinder about a horizontal axis. The speed of rotation and the composition of the slurry are set so as to promote a continuous motion as the cylinder is rotated, so that the media abrades the inside surface.

The abrasive media may be replaced at intervals to prevent the build up of debris that can become embedded in the aluminium surface.

Abrasion exposes a freshly created aluminum surface that reacts directly with the 'local environment' that is established at the metal/solution interfacial region to form a thin layer of aluminum oxides and/or oxyhydroxides on the inside surface of the cylinder. The surfactant, or a product derived from the surfactant, becomes incorporated with this thin layer. The surfactant also modifies the grinding process to produce a 'mirror-like' hydrophobic surface. It is believed that the local environment contains a mixture of very fine particles that may come from the abrasive or from the metal surface. These fine particles may form a gel that assists the polishing action. Surprisingly, in the presence of the surfactant, the grinding process encourages the formation of a disturbed layer in the metal immediately below the oxidised metal. This disturbed layer, which may also incorporate species associated with the surfactant and the oxide, is about 1 micron or less thick and contains heavily deformed metal and an outermost surface layer microstructure that may have an ultra-fine finegrained structure. Such disturbed layers are known to be present on hot or cold rolled aluminum alloys (see for example G Buytaert et al, Surface and Interface Analysis, vol. 37, 534-543, 2005) and the internal surfaces of 'as-extruded' aluminum alloy high-pressure cylinders. These disturbed layers have not previously been found on the internal surfaces of finished gas cylinders because they will have been essentially eliminated during the heat treatment and cleaning processes employed during cylinder manufacture subsequent to the extrusion process.

Any abrasive could be used in the grinding media provided it does not interfere with the formation of the hydrophobic layer or contaminate the surface. The preferred abrasive is alumina because it will not introduce any additional chemical species, such as anions ($Cl^-$, $SO_4^{2-}$, $NO_3^-$, citrate, etc) or cations such as $Fe^{2+}$, $NH_4^+$, etc that can readily influence the nature and chemical reactivity of the surface layers that are generated. Titania might also serve the same purpose but would risk the possibility of introducing titanium based species. Alternatively, zirconium oxide (for example, Ce stabilised $ZrO_2$ having a chemical formula of the general form $ZrO_2CeO_2$) or zirconium silicate, $ZrSiO_4$, may be used.

The abrasive mixture includes a surfactant. The surfactant must be capable of interacting with the surfaces generated during the grinding process to contribute to forming the required protective surface layer on the aluminium. In principle, it would be possible to use any surfactant provided that i) the resulting protective surface layer remains stable in the gaseous atmosphere within the cylinder and ii) the surfactant has the ability to interact with the surface formed during grinding and produce a tenacious hydrophobic layer. A non-ionic surfactant, which has been found to be particularly effective is a coconut oil derivative, namely cocodiethanolamide. Alternative surfactants include palm oil derivatives. It is believed that surfactants derived from many organic acids with a carbon chain length of $C_4$-$C_{18}$, more preferably $C_6$-$C_{18}$ and still more preferably $C_8$-$C_{18}$, will be suitable for this invention.

The abrasive mixture may include an organic acid such as oleic acid. This is believed to interact with the surfactant and/or the abrasive to assist the polishing process. It is believed that the most effective organic acids are carboxylate acids having a carbon chain length of $C_8$-$C_{18}$ such as stearic acid, lauric acid, myristic acid, palmitic acid, oleic acid and behenic acid, with oleic acid being preferred.

In a preferred embodiment the step of abrading the inside surface of the cylinder with an abrasive mixture including alumina and water is preceded by a coarse cleaning step intended to remove the initial surface layer left by the manufacturing process, usually extrusion followed by heat treatment. This could be achieved using the aforementioned abrasive mixture including alumina and water but, unless the inside surface has been left in an unusually smooth state, the process would take an extended time period. An initial step, using a coarser abrasive, will quickly remove extreme surface roughness and provide a surface suitable to carry out the less aggressive grinding step using alumina. A surfactant may be added at this stage to assist in rinsing the abrasive from the cylinder.

The cleaning step can be by chemical dissolution of the surface, for example, in an acid or alkaline solution. An alkaline solution is preferred, for example sodium hydroxide in water, as this avoids the inevitable introduction of an additional anionic species associated with acid additions, for example, $Cl^-$, $SO_4^{2-}$, $NO_3^-$ and citrate ions associated with hydrochloric, sulphuric, nitric and citric acid additions, respectively. This chemical treatment could then be followed by a short abrasive cleaning with a coarse abrasive or by the final abrasion.

A combined cleaning step in which part of the water is replaced by an alkaline or acid reagent is also envisaged in which the mechanical abrasion brought about by tumbling is supplemented by chemical action. Where an acid or alkaline is used, extra washing procedures will be required before the final grinding stage.

After the coarse cleaning step, the cylinder is rinsed with a suitable fluid such as de-ionised water. If required, several coarse cleaning steps can be applied, perhaps gradually reducing the coarseness of the abrasive at each step, in the conventional manner. Preferably, the cylinder is rinsed out between such coarse grinding steps.

The coarse grinding step or steps can be carried out by wet grinding using an abrasive mixture comprising an abrasive and a liquid, such as water, tumbled in the manner described below. However, the coarse grinding step or steps may also be carried out by dry grinding, i.e. using abrasive alone. Whether wet or dry grinding is chosen, a particularly suitable abrasive has been found to contain zirconium oxide, $ZrO_2$. Zirconium oxide is a relatively non-reactive substance, which will not chemically react with the cylinder material during the abrasion process. It may be in the form of zircon ($ZrO_2SiO_2$) embedded in a polyester matrix. Other coarse abrasives that can be used include SiC and $SiO_2$.

In accordance with a second embodiment of the invention there is provided a container for the storage of gas, said container being made from or lined with aluminium or an aluminium alloy. The aluminium or aluminium alloy, provided of course that it is a heat treatable alloy, may have been solution heat treated. The solution treatment is preferably given after the cylinder or cylinder liner has been formed to shape. The solution treated alloy may have been given a precipitation hardening treatment. The internal surface of the container has a substantially continuous disturbed layer and is preferably hydrophobic with a contact angle of typically greater than 80°. The internal surface may incorporate groups or species derived from the surfactant and/or comprise oxides or oxyhydroxides of aluminium. The cylinder may be intended to contain any gas or indeed liquid, provided that the contents do not promote a time-dependent loss of the cylinder's structural integrity. Examples of gases which can be stored in such cylinders include high purity arsine, $H_2S$, nitrogen oxides, sulphur dioxide (these gases may be mixed with carrier gases such as air or nitrogen) and mixtures of various organic gases, such as those used as calibration standards for air pollution and automotive exhaust emission evaluation.

Generation of particulates from the inside of the cylinder can be a problem, especially when the gas is intended for use in the electronics industry. It is anticipated that cylinders treated by the present invention will effectively prevent particulate generation during high-pressure gas storage. Thus, the gas being stored only comes into contact with the internal layer on the inside of the container that provides improved gas stability during storage.

Preferably the inside surface is sufficiently smooth to exhibit a 'mirror-like' finish. Preferably also the surface is hydrophobic. The presence of moisture within a gas cylinder is generally undesirable. Preferably, the hydrophobic layer does not release water to the contents of the container during storage.

Preferably the aluminium under the 'surface layer' exhibits a disturbed layer. It is believed that this disturbed layer may help species associated with the surfactant to become incorporated in the outer aluminium surface layer.

The method and container of the invention will now be described in detail, by way of example only, and with reference to the accompanying figures, in which:

FIG. 1 is a sectional view through a gas cylinder during the wet grinding process.

Figure 2:
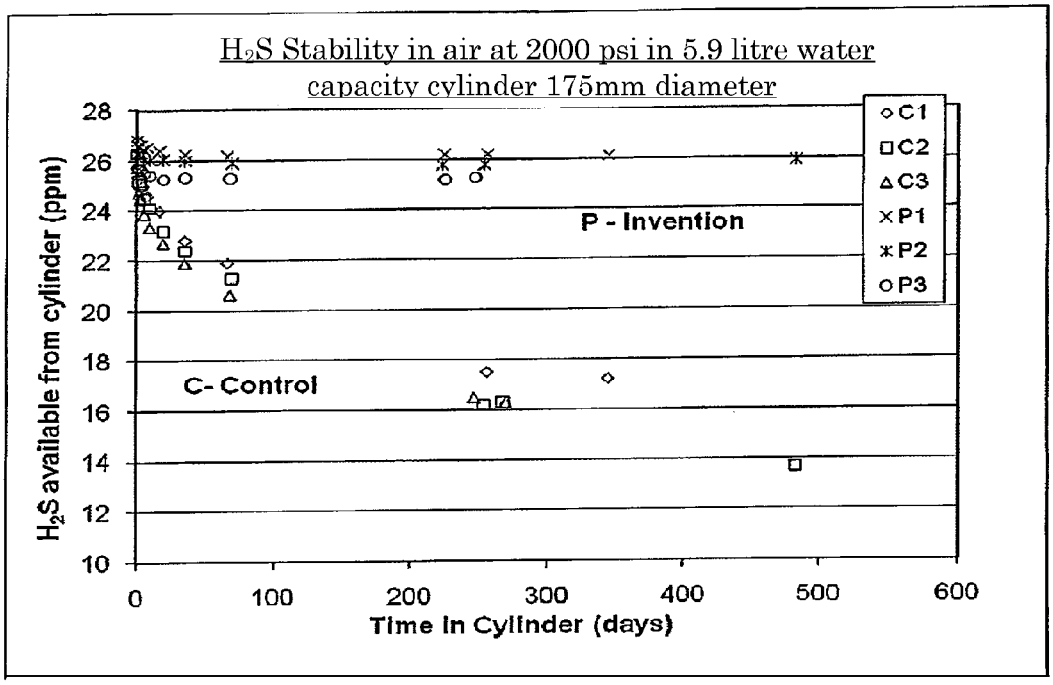

FIG. 2 presents gas stability data for various cylinders (Example 14).

Figure 3:
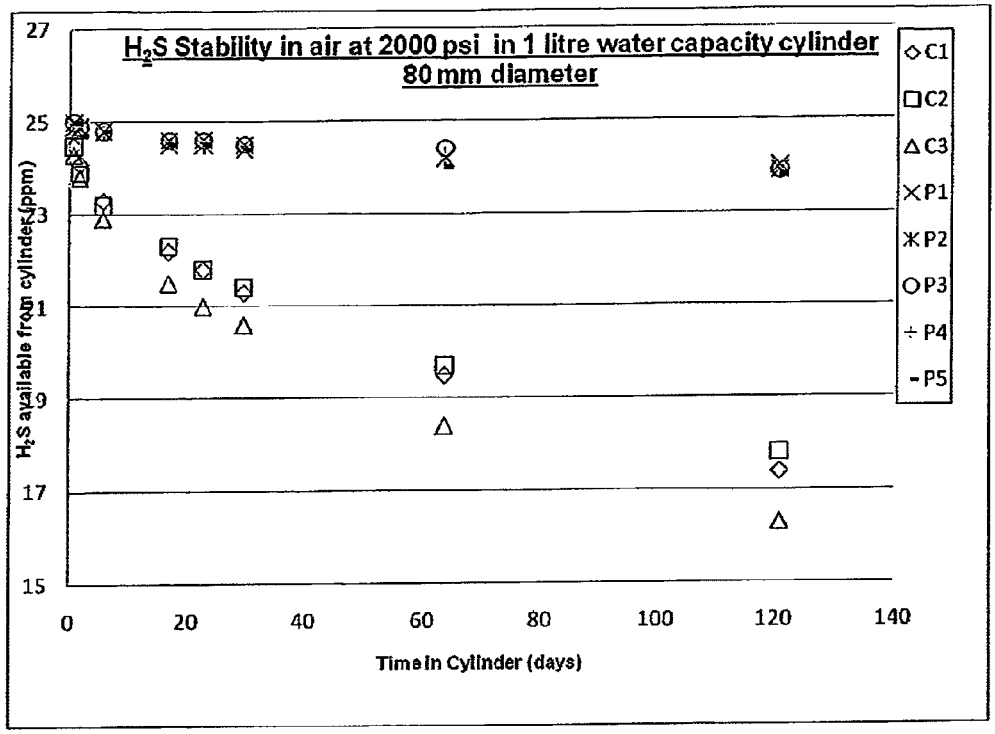

FIG. 3 presents gas stability data for various cylinders (Example 14).

Figure 4A:
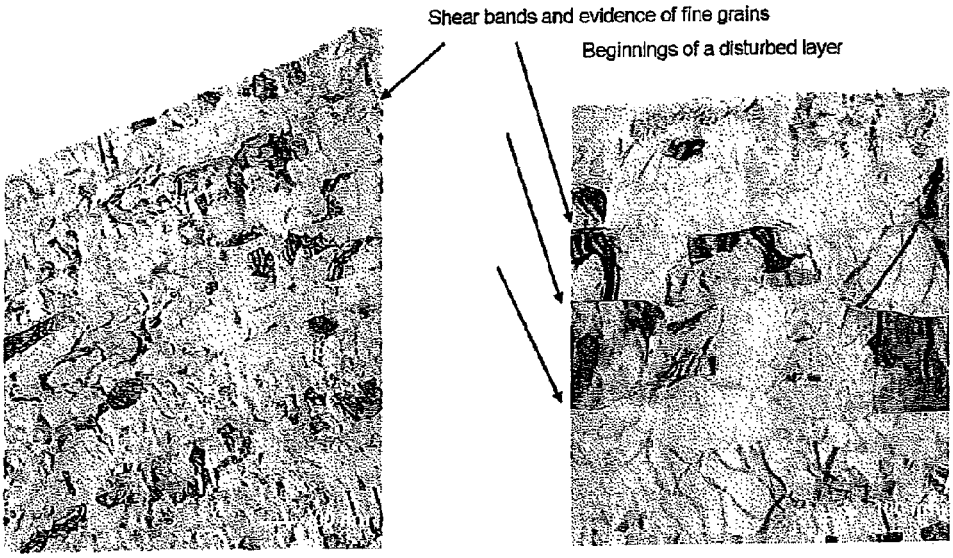
Figure 4B:
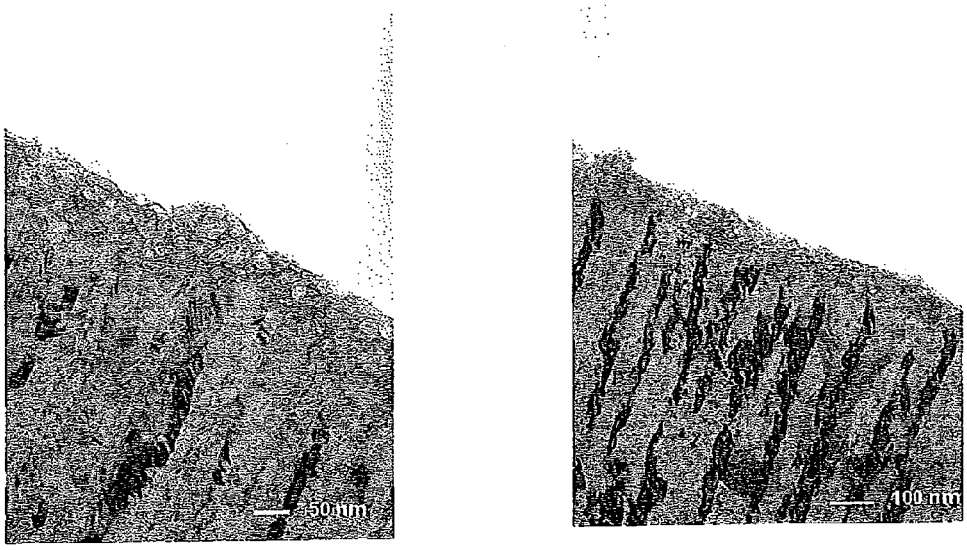
Figure 4C:
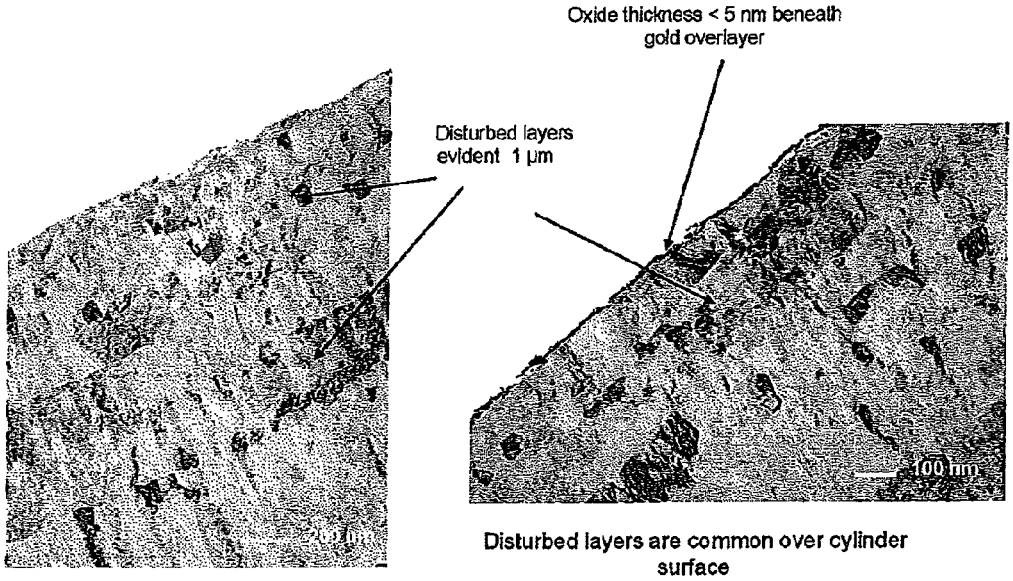

FIGS. 4*a*, 4*b* and 4*c* are electronmicrographs of sections through the wall thickness of various gas cylinders (Example 15).

Figure 5:
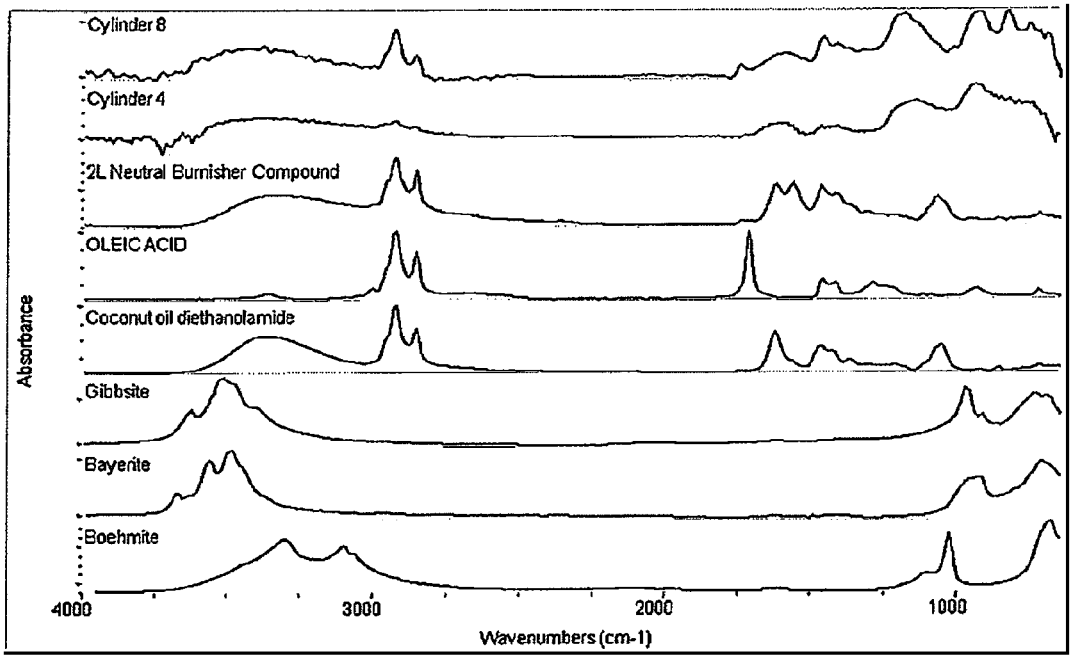

FIG. 5 shows IR spectra obtained from the interior surfaces of various gas cylinders (Example 16).

The method to be described was carried out on a conventional pressure cylinder intended for storage of gas, and made of aluminium or an alloy thereof. Unless stated otherwise, the cylinders under test were made from AA6061 alloy, but other alloys, such as AA7032 alloy could be used.

The hydrophobicity of the treated surfaces of the containers produced in the following examples was measured by means of a Ramé-Hart Contact Angle Goniometer. Samples were cut from the cylinders being tested and a drop of water placed on the edge of the treated side of the sample. The contact angle of the drop was then measured using the goniometer. A large contact angle indicates that the surface is hydrophobic and a small contact angle indicates that it is hydrophilic. In the examples, the contact angle is quoted as a measure of the degree of hydrophobicity.

EXAMPLE 1

Following manufacture, the inside surface was subjected to a coarse wet grinding step to remove extrusion or other irregularities reasonably rapidly. To achieve this, the cylinder (80 mm in diameter and having an internal volume of about 1 liter) was one third to a half filled with abrasive prisms and sufficient de-ionised water added to just cover them. The prisms, supplied by Manufacturers Services Inc, El Monte Calif., were about 6 mm (0.25 inches) along each edge and comprised a zirconium compound in a hard polyester. The cylinder was then rotated about a horizontal axis at about 90-140 rpm so that the zirconium oxide containing prisms generate the necessary conditions to abrade the inside surface of the cylinder. The grinding was continued for 24 hours to remove a thin surface layer of material from the inside surface (depth removed<25 microns).

This is illustrated diagrammatically in FIG. 1 which shows the cylinder under reference 1 in cross section. The inside surface of the cylinder is shown under reference 2. The abrasive mixture of zirconium oxide and water is shown under reference 3. To achieve tumbling of the abrasive mixture, the cylinder was oriented so that its longitudinal axis is horizontal and was then rotated. Rotation may be in one direction, such as clockwise, as represented by the arrow A, or may be reciprocatory, i.e. alternately clockwise and anticlockwise.

Following the coarse wet grinding step, the abrasive mixture was emptied out and the cylinder was then rinsed with de-ionised water. A section was cut from the cylinder and examined by scanning electron microscopy (SEM) which revealed that the extrusion defects were removed suggesting that the initial grinding treatment is adequate.

EXAMPLE 2

A cylinder was prepared as in Example 1. The inside surface of the cylinder was subjected to a fine wet grinding step to provide a smoother polished finish to the inside surface. To achieve this the cylinder was half filled with 3 mm (0.125 inch) diameter alumina balls containing 99.8% alumina and supplied by Coors Porcelain and these were just covered with de-ionised water. The cylinder was rotated about a horizontal axis in the manner illustrated in FIG. 1. After 1 hour, the media was removed, the cylinder washed with deionised water and the fine grinding process repeated using the same alumina with fresh media. This was repeated using either the same or fresh alumina with fresh media to give a total of three separate fine grinding steps all with the same grade of alumina. Again, the abrasive slurry generated the necessary conditions over the inside surface of the cylinder, to suitably abrade the cylinder's internal surfaces. At the same time, surface material exposed by the grinding is exposed to an aqueous environment so that the result is a thin oxide or oxyhydroxide layer covering the inside surface of the cylinder.

Examination of a section cut from the cylinder shows that the surface is smooth but has a dull, matt surface finish. Examination of a section cut through the thickness revealed that the aluminium alloy exhibited a patchy and partially developed disturbed layer. The surface was weakly hydrophilic. The contact angle was about 57°.

EXAMPLE 3

A cylinder was prepared as in Example 2 except that 20 g of LL Neutral Burnisher Compound manufactured by U-M Abrasives, Inc. of 831 Trent St, Kennedale, Tex., USA were added to both the coarse grinding and the fine polishing media. This burnishing compound contains oleic acid and cocodiethanolamide in alcohol.

Examination of a section cut from the treated cylinder shows that the surface is smooth and has a 'mirror-like' finish with a CLA value of less than 1 micron. The surface is strongly hydrophobic. A section through the wall of the cylinder reveals a continuous layer of disturbed metal at the inner surface of the aluminium of the cylinder.

Initial gas stability results indicate a cylinder internal surface treated according to this invention provides a significantly improved gas stability for a gas mixture of 25 ppm $H_2S$ in air stored at 2000 psi.

Hydrophobicity measurements for the internal surfaces of a freshly cut sample from a treated cylinder yielded a contact angle of 90-110°, which was found to have reduced to a value of 71° after several weeks exposure to laboratory air.

EXAMPLE 4

A cylinder was prepared as in Example 3, but the surfactant was added at the coarse grinding stage and omitted from the fine grinding stage. The resulting surface was matt and weakly hydrophilic with a contact angle of only 45°.

EXAMPLE 5

A cylinder in the as produced state, i.e. extruded, heat treated and cleaned in a conventional manner which does not involve grinding, and a cylinder treated as described in Example 2 were filled with deionised water and surfactant in the same concentration as used in Example 3 and then the cylinders were rotated for 24 hours. The resulting surface for the as-produced cylinder remained rough and that for the cylinder treated as described in Example 2 remained smooth. The internal surface of both cylinders remained matt and neither became hydrophobic. This illustrates that grinding in the presence of the surfactant is essential to produce the hydrophobic surface.

EXAMPLE 6

A cylinder was prepared as in Example 3; in this case the cylinder being made from AA7032 alloy. The interior surface of this cylinder was not as smooth as the softer AA6061 alloy cylinders used in the previous examples and some extrusion blemishes remained. This suggests that the coarse grinding treatment needs to be increased because AA7032 is a harder aluminium alloy than that used in the preceding examples. However, the general surface was hydrophobic and generally 'mirror-like', and although less so than in Example 3, it is expected that this will be improved by further tumbling.

A contact angle of 80° was found on a sample measured soon after it was cut from a capped cylinder.

EXAMPLE 7

A sample was cut from the cylinder produced in Example 3 and the cylinder's internal surface was exposed to ordinary laboratory atmosphere. The hydrophobicity of the surface was found to decrease with exposure to the atmosphere. This did not happen during three months when the surface was inside a capped cylinder. This suggests that the treated surface remains stable in contact with air in the confines of a capped cylinder but is not so stable when there is an unlimited supply of air. The implication is that treated cylinders must remain protected either by capping or by filling with an appropriate gas.

A sample exposed to laboratory air for several months was measured and found to have a contact angle of 60°. The value was 71° after a few weeks exposure—see Example 3 above.

EXAMPLE 8

Example 3 was repeated but without the surfactant present and with an oleic acid concentration of 5%. This is believed to be a higher concentration than is present in the commercial LL Neutral Burnisher Compound. There was no alcohol present in the mixture. After grinding, the surfaces became coated with a black sticky product that was difficult to remove. This black sticky product was not generated by the above procedure when the acidic solution within a cylinder was neutralized by the addition of a few cc's of aqueous sodium hydroxide solution prior to the grinding process.

EXAMPLE 9

Example 8 was repeated but with an oleic acid concentration of 1.5% and the solution adjusted to pH 8 by the addition of NaOH solution before polishing commenced. A hydrophobic layer having a contact angle of 96° was produced. The surface was, however, black streaked possibly because the solution became acid during the polishing operation. It is believed that the use of a buffer solution to maintain the pH during polishing would overcome the streaking problem.

EXAMPLE 10

Example 3 was repeated but without the oleic acid present during the final polishing with alumina. The concentration was 20 ml of cocodiethanolamide in alcohol in 200 ml of water, which is believed to be about the same as in the burnishing compound.

The resulting surface was similar to that produced in Example 3, but was slightly less hydrophobic with a contact angle of around 80° as opposed to the 90-110° generated in Example 3.

EXAMPLE 11

Example 3 was repeated but the alumina used in the final stage was replaced by zirconium dioxide stabilised with ceria. This medium was obtained from Fox Industries Inc, sold under the trade name Fox Zirconium Oxide Beads Ceria Stabilized.

The resulting surface was polished and shiny but appeared qualitatively different to that obtained in Example 3 and it seemed to be less hydrophobic.

EXAMPLE 12

Example 11 was repeated but using Fox Zirconium Silicate Beads obtained from Fox Industries Inc. The results were similar to Example 11.

EXAMPLE 13

Example 3 was repeated but with just alumina and water with the addition of 20 ml of one of a range of commercial surfactants with various carbon chain lengths. The burnishing compound was omitted other than when it was used as the source of the surfactant in Sample No. 8 (see Table 1).

The surfactants used were trisodium nitrotriacetate monohydrate (Ultramatic Equipment Company), VF-103 (Vibra Finish Company) and VF-77T (Vibra Finish Company), which provided maximum carbon chain lengths of 1, 4 and 10 respectively.

While all the resulting surfaces were smooth, the hydrophobicity of the surfaces was clearly dependent on the surfactant carbon chain length chain, with contact angles increasing from below 10° for the shortest chain length (highly hydrophilic) through to 90-110° (hydrophobic) for the longest chain length associated with the burnishing compound used in Example 3. Contact angles were measured within ten minutes of cutting samples from the cylinders and exposure to laboratory air. The results are summarized below in Table 1.

TABLE 1

| Sample No. | Surfactant Addition | Constituent with Longest Carbon Chain Length | Longest Carbon Chain Length | Contact Angle | Surface Appearance |
|---|---|---|---|---|---|
| 42 | Trisodium nitrotriacetate monohydrate† | Trisodium nitrotriacetate monohydrate | 1 | <10 | Dull |
| 41 | VF-103* | Diethanolamine | 4 | 48 | Shiny |
| 40 | VF-77T* | Ethylenediamine-tetraacetic acid | 10 | 85 | Shiny |
| 8 | LL Burnishing Compound | Oleic acid | 18 | 90-110 | Shiny |

†Manufactured by Ultrametic Equipment Company
*Manufactured by Vibra Finish Company Hamilton OH

EXAMPLE 14

5.9 liter and 1.0 liter internal capacity cylinders were prepared as described in Example 3. These were filled with air and contained approximately 25 ppm of $H_2S$ at a pressure of 2000 psi. The cylinders were held at room temperature for an extended period of time and samples of the mixture drawn off at intervals for analysis. Comparative cylinders were prepared by conventional means which include an acid wash as the final treatment of the internal surfaces. These were filled and stored in the same way as the cylinders of the present invention.

FIG. 2 charts the results of tests carried out in triplicate for a reactive gas ($H_2S$) in air stored in 5.9 liter cylinders prepared in the manner described above. In the upper part of the Figure is a graph of gas concentration in parts per million (ppm) plotted against time period, represented as dates from 14 Dec. 2005 to 29 Nov. 2006. The corresponding concentration figures, in ppm, are also presented as a table in the lower part of the Figure.

The points in the graphs with the reference P are those taken from cylinders treated according to the present invention, and clearly show only a small fall in gas concentration over the test period. By contrast, the conventionally treated cylinders all show a fall in concentration over the test period, in some cases this fall being quite significant, and certainly sufficient to render the stored gas effectively useless for calibration purposes.

FIG. 3 is a corresponding plot for the 1 liter capacity cylinders. The effectiveness of the treatment of the present invention is again demonstrated. Moreover, tests on these small cylinders are more stringent because the greater surface area to volume ratio amplifies the effects of the cylinder surface.

Testing and data generation for this example were performed in close cooperation with The Linde Group.

EXAMPLE 15

A thin section through the wall thickness of a conventionally produced "as-extruded" 4.6 liter AA6061 cylinder, prior to any subsequent heat treatment, was examined under a transmission electron microscope. The inner surface was found to have a pronounced disturbed layer exhibiting shear bands and fine crystal structure (see FIG. 4*a*).

A section through a corresponding cylinder subjected to the conventional manufacturing process of solution treatment at about 550° C. followed by water quenching and ageing at 175° C. showed that the disturbed layer was absent. FIG. 4*b* shows the surface region free of disturbed layer and with an oxide film formed during heat treatment. The shear bands and the surface fine grains associated with the disturbed layer have been effectively removed by heat treatment.

This shows that conventionally produced cylinders of the type used as in the previous examples do not have a disturbed layer on the inner surface of the cylinder before the grinding/polishing treatment is carried out.

The inner surfaces of cylinders treated as in Example 3 were next examined under the electron microscope. These showed a strong disturbed layer of about 1 micron thick. FIG. 4*c* shows a typical example of the presence of shear bands in the surface region characteristic of a disturbed layer. A layer of fine crystals was also present at the surface of the disturbed layer. In this example, a thin gold layer was applied to the sample examined in the electron microscope to preserve the surface during examination. It is not part of the invention.

These results are evidence that the disturbed layer formed during extrusion of the cylinder is removed during heat treatment. All cylinders made from a heat treatable alloy are heat treated before use. The grinding and polishing in the presence of a surfactant treatment of the present invention introduces a continuous disturbed layer under the polished surface of the interior of the cylinder. This disturbed layer is believed to play an important part in the formation of the gas stability coating on the inside of the cylinder.

EXAMPLE 16

The interior surfaces of cylinders produced as in Example 3 were examined by IR spectroscopy using the following experimental conditions to investigate the organic and inorganic layers produced on the surface: Infrared spectra of oxide surfaces were collected using an attenuated total reflectance (ATR) attachment on a Fourier transform infrared (FTIR) microscope. The use of such an attachment involves bringing a silicon sphere (diameter ca 3 mm) in contact with the surface to be studied under some pressure. The infrared beam is focussed on to the face of the sphere from which it is reflected. The surface in contact with the sphere is analysed by the infrared beam. Spectra were collected by scanning between 650 and 4000 $cm^{-1}$. To improve signal to noise ratio, the spectra were collected by averaging 1024 scans.

The resulting spectra (absorbance) are shown in FIG. 5. The top trace (cylinder 8) is for the interior surface of a cylinder produced as per Example 3. The trace was taken soon after the surface was exposed to laboratory air and before any of the changes noted in Example 7 had occurred.

A corresponding trace from a conventionally produced gas cylinder is shown in the second from top trace (cylinder 4).

For comparison purposes, traces were also made on the burnishing compound and the individual constituents of the compound, and on oxyhydroxides that may be present on aluminium surfaces. Comparison of cylinders 4 and 8 reveal the presence of additional species on the surface of the cylinder treated by this invention compared with conventionally treated cylinders. The peaks around 2900 arise from an organic layer on or near the surface of the treated cylinders derived from the polishing media. There is a further peak at about 1742 that is believed to be generated from the surfactants during the grinding process. The organic layer appears to be derived from the surfactants and to products generated from them. A further set of peaks broadly coincide with the oxyhydroxides some of which are represented by boehmite, bayerite and gibbsite.

The results clearly show the presence of an organic layer on the surface of the treated cylinders together with oxyhydroxides of aluminium.

What is claimed is:

1. A method of treating an internal surface of a gas storage container, said container being made from or lined with aluminium or aluminium alloy, the method comprising creating a freshly exposed hydrophobic surface on the internal surface in the presence of a surfactant, wherein the surfactant is a non-ionic surfactant derived from an organic acid with a carbon chain length of $C_6$-$C_{18}$, such that a layer of one or more aluminium oxides or oxyhydroxides is formed on the internal surface of the container and which incorporates the surfactant or a product derived from the surfactant, and the aluminium alloy is an alloy selected from the group consisting of the AA2XXX series, AA5XXX series, AA6XXX series, AA7XXX series, and AA8XXX series.

2. A method as claimed in claim 1, wherein the freshly exposed aluminium surface is created by a wet grinding method which involves the use of a mixture comprising an abrasive, a surfactant and water.

3. A method as claimed in claim 1, wherein the surfactant is a non-ionic surfactant.

4. A method as claimed in claim 1, wherein the surfactant is derived from carboxylic acids with a carbon chain length of $C_6$-$C_{18}$.

5. A method as claimed in claim 2, wherein the wet grinding method is preceded by a coarse cleaning step.

6. A method as claimed in claim 1, wherein the aluminium alloy is selected from the group consisting of AA6061, AA7032 and AA7060.

7. A method of treating an internal surface of a gas storage container, said container being made from or lined with aluminium or aluminium alloy, the method comprising creating a freshly exposed hydrophobic surface on the internal surface by wet grinding in the presence of an abrasive mixture comprising a non-ionic surfactant derived from an organic acid with a carbon chain length of $C_6$-$C_{18}$, an abrasive, water and optionally an organic acid such that a layer of one or more aluminium oxides or oxyhydroxides is formed on the internal surface of the container and which incorporates the surfactant or a product derived from the surfactant, wherein the aluminium alloy is an alloy selected from the group consisting of the AA2XXX series, AA5XXX series, AA6XXX series, AA7XXX series, and AA8XXX series, and the abrasive is chosen to avoid introduction of ions selected from Cl−, $SO_4$2−, $NO_3$−, citrate, $Fe_2$+, $NH_4$+.

8. A method as claimed in claim 7, wherein the wet grinding method is preceded by a coarse cleaning step.

9. A method as claimed in claim 7, wherein the aluminium alloy is selected from the group consisting of AA6061, AA7032 and AA7060.

10. The method of claim 7, wherein the abrasive mixture includes the organic acid.

11. The method of claim 10, wherein the organic acid is selected from the group consisting of carboxylate acids having a carbon chain length of $C_8$-$C_{18}$, stearic acid, lauric acid, myristic acid, palmitic acid, oleic acid and behenic acid.

12. The method of claim 7, wherein the abrasive is selected from the group consisting of alumina, titania, zirconium oxide, Ce stabilised $ZrO_2$ having a chemical formula of the general form $ZrO_2CeO_2$, and $ZrSiO_4$.

13. The method of claim 7, wherein the abrasive is alumina.

14. A method of treating an internal surface of a gas storage container made from or lined with aluminium or aluminium alloy and creating a freshly exposed hydrophobic surface on the internal surface, the method comprising wet grinding the internal surface in the presence of an abrasive mixture consisting of a non-ionic surfactant derived from an organic acid with a carbon chain length of $C_6$-$C_{18}$, an abrasive, water and optionally an organic acid such that a layer of one or more aluminium oxides or oxyhydroxides is formed on the internal surface of the container and which incorporates the surfactant or a product derived from the surfactant, wherein the aluminium alloy is an alloy selected from the group consisting of the AA2XXX series, AA5XXX series, AA6XXX series, AA7XXX series, and AA8XXX series.

15. A method as claimed in claim 14, wherein the wet grinding is preceded by a coarse cleaning step.

16. A method as claimed in claim 14, wherein the aluminium alloy is selected from the group consisting of AA6061, AA7032 and AA7060.

17. The method of claim 14, wherein the abrasive mixture includes the organic acid.

18. The method of claim 17, wherein the organic acid is selected from the group consisting of carboxylate acids having a carbon chain length of $C_8$-$C_{18}$, stearic acid, lauric acid, myristic acid, palmitic acid, oleic acid and behenic acid.

19. The method of claim 14, wherein the abrasive is selected from the group consisting of alumina, titania, zirconium oxide, Ce stabilised $ZrO_2$ having a chemical formula of the general form $ZrO_2CeO_2$, and $ZrSiO_4$.

20. The method of claim 14, wherein the abrasive is alumina.

* * * * *